US008919023B2

(12) United States Patent
Merritt et al.

(10) Patent No.: US 8,919,023 B2
(45) Date of Patent: Dec. 30, 2014

(54) SYSTEMS AND METHODS FOR PROVIDING A CUSTOMIZABLE FIREARM

(75) Inventors: Michael Merritt, Moab, UT (US); LuDean Merritt, Moab, UT (US)

(73) Assignee: Launcher Technologies, Inc., Moab, UT (US)

( * ) Notice: Subject to any disclaimer, the term of this patent is extended or adjusted under 35 U.S.C. 154(b) by 52 days.

(21) Appl. No.: 13/308,470

(22) Filed: Nov. 30, 2011

(65) Prior Publication Data

US 2013/0133236 A1 May 30, 2013

(51) Int. Cl.
*F41A 17/00* (2006.01)

(52) U.S. Cl.
USPC ..... 42/70.01; 89/161; 89/162

(58) Field of Classification Search
USPC ..... 42/1.09, 1.11, 1.12, 1.14, 1.15, 1.16, 42/10, 11, 52, 53, 69.01, 105, 146; 89/160, 161, 162, 163
See application file for complete search history.

(56) References Cited

U.S. PATENT DOCUMENTS

| | | | | | |
|---|---|---|---|---|---|
| 886,211 | A | * | 4/1908 | Hino | 89/139 |
| 975,720 | A | | 11/1910 | Risser | |
| 1,073,312 | A | | 9/1913 | Woods | |
| 1,436,534 | A | | 11/1922 | Russell et al. | |
| 1,897,992 | A | * | 2/1933 | Ailes | 42/2 |
| 2,042,934 | A | | 6/1936 | Gill | |
| 2,512,998 | A | * | 6/1950 | Brock | 42/106 |
| 2,601,613 | A | | 6/1952 | Jahncke | |
| 2,775,178 | A | * | 12/1956 | Chambers et al. | 172/316 |
| 3,020,662 | A | * | 2/1962 | Merkel | 42/11 |
| 3,318,033 | A | | 5/1967 | Barr | |
| 3,707,794 | A | | 1/1973 | Rocha et al. | |
| 3,707,946 | A | * | 1/1973 | Muhlbach | 118/410 |
| 3,788,191 | A | | 1/1974 | Rose et al. | |
| 3,938,262 | A | | 2/1976 | Dye et al. | |
| 4,028,994 | A | * | 6/1977 | Ferluga | 89/161 |
| 4,061,075 | A | * | 12/1977 | Smith | 89/132 |
| 4,083,138 | A | | 4/1978 | Cash | |
| 4,086,682 | A | * | 5/1978 | Hancox | 42/1.12 |
| 4,176,606 | A | | 12/1979 | King et al. | |
| 4,268,987 | A | | 5/1981 | Cash | |
| 4,348,716 | A | | 9/1982 | Storm et al. | |
| 4,411,086 | A | | 10/1983 | Christopherson | |
| 4,524,534 | A | | 6/1985 | Kaye et al. | |
| 4,533,980 | A | | 8/1985 | Hayes | |

(Continued)

FOREIGN PATENT DOCUMENTS

WO WO 2009/057175 A1 5/2009

*Primary Examiner* — Gabriel Klein
(74) *Attorney, Agent, or Firm* — David B. Tingey; Bryant J. Keller; Kirton McConkie

(57) ABSTRACT

A customizable firearm is disclosed. The firearm can perform one or more functions, including firing a bullet, firing a less-than-lethal projectile, and/or providing light. In some cases, the firearm includes a main frame component having an inner cavity, wherein a barrel is slidably received within the cavity so as to selectively slide back and forth within the cavity. In some cases, a proximal end of the barrel comprises a bullet chamber. In such cases, the barrel fires the bullet by carrying the bullet proximally and striking it against a stationary firing pin. In other cases, a firing pin is attached to a distal end of the barrel. In such cases, the barrel discharges the firearm by moving the firing pin distally and striking a cartridge at a distal end of the main frame. In some cases, the barrel rotates between a safe and a fire alignment. Other implementations are described.

20 Claims, 17 Drawing Sheets

(56) References Cited

U.S. PATENT DOCUMENTS

| | | | | |
|---|---|---|---|---|
| 4,644,930 | A * | 2/1987 | Mainhardt | 124/58 |
| 4,707,772 | A | 11/1987 | Jimenez et al. | |
| 4,748,759 | A * | 6/1988 | Whiteing | 42/1.09 |
| 4,905,396 | A | 3/1990 | Bechtel | |
| 5,092,071 | A | 3/1992 | Moore | |
| 5,107,612 | A | 4/1992 | Bechtel | |
| 5,123,329 | A * | 6/1992 | Irwin | 89/161 |
| 5,345,707 | A | 9/1994 | Randall | |
| 5,355,608 | A | 10/1994 | Teetzel | |
| 5,388,361 | A * | 2/1995 | Farr | 42/1.16 |
| 5,430,967 | A | 7/1995 | Woodman, III et al. | |
| 5,621,999 | A | 4/1997 | Moore | |
| 5,704,155 | A | 1/1998 | Primeau, IV | |
| 5,727,346 | A | 3/1998 | Lazzarini et al. | |
| 6,270,231 | B1 | 8/2001 | Kerr | |
| 6,295,751 | B1 | 10/2001 | Piwonski | |
| 6,565,226 | B1 | 5/2003 | Cummings | |
| 6,964,220 | B1 * | 11/2005 | Lavin | 89/159 |
| 7,305,790 | B2 | 12/2007 | Kay | |
| 7,524,076 | B2 | 4/2009 | Kukuk | |
| 7,866,083 | B2 | 1/2011 | Teetzel | |
| 7,905,042 | B2 | 3/2011 | Carmel et al. | |
| 7,954,273 | B1 * | 6/2011 | Swan | 42/115 |
| 8,109,032 | B2 | 2/2012 | Faifer | |
| 8,127,485 | B2 | 3/2012 | Moore et al. | |
| 8,136,284 | B2 | 3/2012 | Moody et al. | |
| 8,191,302 | B1 | 6/2012 | Swan | |
| 8,327,574 | B2 | 12/2012 | Sandler et al. | |
| 8,529,083 | B1 | 9/2013 | Reed et al. | |
| 2002/0144446 | A1 | 10/2002 | Lindahl | |
| 2006/0027091 | A1 | 2/2006 | Ratti | |
| 2007/0151114 | A1 | 7/2007 | Papp et al. | |
| 2011/0252681 | A1 | 10/2011 | Houde-Walter et al. | |

* cited by examiner

SYSTEMS AND METHODS FOR PROVIDING A CUSTOMIZABLE FIREARM

BACKGROUND OF THE INVENTION

1. Field of the Invention

The present invention relates to firearms. In particular, the present invention relates to systems and methods for making and using a firearm that can be customized to perform one or more functions, such as firing a bullet, firing a less-than-lethal projectile, and/or providing light.

2. Background and Related Art

Guns currently exist that have characteristics to make them more practical or better suited for certain uses. For example, while some guns are specially configured for use in hunting, other guns are designed to be used in combat and tactical situations. Similarly, while some guns have longer barrels to increase their accuracy and bullet velocity, other guns have shorter barrels to make them easier to conceal. As a general rule, guns that are mounted against a user's shoulder, such as rifles and shotguns, are called long guns, while guns that can be held and operated with a single hand, such as pistols and revolvers, are called handguns.

Handguns can be useful for a variety of purposes. For instance, because some handguns are relatively small, they may be more practical than some long guns for use indoors and in situations where the object being shot at is relatively close to the shooter. Additionally, because some handguns can easily be hidden on a user's person or in a user's bag, the user can carry such a gun without calling attention to that fact. As a result, the user can carry the handgun without causing unnecessary fear or anxiety to bystanders.

Despite their utility, handguns are not necessarily without their shortcomings. Some handguns are intended to be readily fired, so the safety mechanisms on such guns can be relatively easily to disengage or even be non-existent. Accordingly, some such handguns may discharge unintentionally—potentially causing damage to property and even injury or death to the guns' users or to others.

While techniques currently exist that are used to provide handguns for a variety of purposes, challenges still exist. Accordingly, it would be an improvement in the art to augment or even replace current techniques with other techniques.

SUMMARY OF THE INVENTION

The present invention relates to firearms. In particular, the present invention relates to systems and methods for making and using a firearm that can be customized to perform one or more functions, such as firing a bullet, firing a less-than-lethal projectile, and/or providing light.

Implementation of the present invention takes place in association with a firearm. In some instances, the firearm is customizable to perform one or more functions, such as firing a bullet, firing a less-than-lethal projectile, and/or providing light. The firearm generally includes a main frame component having an inner cavity, wherein a barrel is slidably received within the cavity so as to selectively slide proximally and distally (or back and forth) within the cavity. In some cases, a proximal end of the barrel comprises a projectile chamber. In such cases, the barrel fires the projectile by carrying the projectile proximally from a distal cocked position and striking the projectile against a stationary firing pin. In other cases, a firing pin is attached to a distal end of the barrel. In such cases, the barrel discharges the firearm by moving from a proximal cocked position so that the firing pin moves distally to strike a projectile housed in a launching platform at a distal end of the main frame. In some cases, the barrel rotates between a safe and a fire alignment.

In order to selectively lock the barrel in a cocked position (including a distal cocked position or a proximal cocked position), some implementations of the barrel comprise a catch on the barrel's outer surface. In such implementations, the firearm comprises a sear that runs transversely to a length of the barrel, wherein the sear is sized and shaped to selectively engage the catch when the barrel is in a cocked position and to disengage the catch to allow the barrel to slide to a discharged position.

While the methods and processes of the present invention can be particularly useful in the area of handguns, those skilled in the art can appreciate that the described methods and processes can be used in a variety of different applications and in a variety of different areas of manufacture to yield a variety of different guns, including long guns, cannons, artillery, and other mechanisms that can be used to launch a projectile.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to firearms. In particular, the present invention relates to systems and methods for making and using a firearm that can be customized to perform one or more functions, such as firing a bullet, firing a less-than-lethal projectile, and/or providing light.

Figure 1:
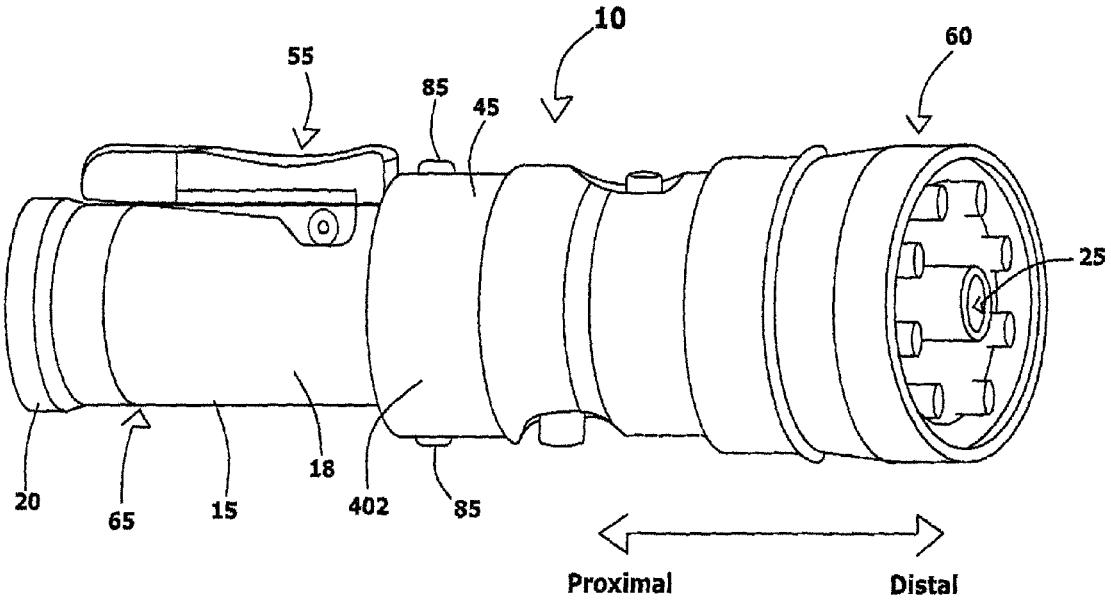
FIG. 1 illustrates a perspective view of a representative embodiment of a firearm comprising a flashlight.

In general, this disclosure describes a firearm that has a barrel that is able to move distally and/or or proximally within the firearm to cause a projectile to be discharged or be fired therefrom. Additionally, some embodiments of the firearm comprise a safety mechanism in which the barrel itself is selectively rotatable between a fire alignment and a safe alignment. FIG. 1 shows a representative embodiment of such a firearm 10.

The described firearm 10 can be configured to shoot or discharge one or more types of projectiles. In this regard, some examples of suitable projectiles include a bullet, such as a rim-fire cartridge (e.g., a .22 round, a .22 magnum round, a .17 HMR round, a .17 HM2 round, etc.) and/or a center-fire cartridge (e.g., a 9 mm round, a .223 round, a shotgun cartridge, etc.); a blank round; a bean bag; a grappling hook and cord; a net; a cable; a rope; a golf-ball; a flash-bang; a tranquilizer; a flare; a grenade; a cartridge (e.g., a tear gas cartridge, a smoke bomb cartridge, an electricshock weapon cartridge, etc.); confetti; and/or any other object or objects that can be fired, shot, or otherwise discharged from the firearm.

Figure 2:
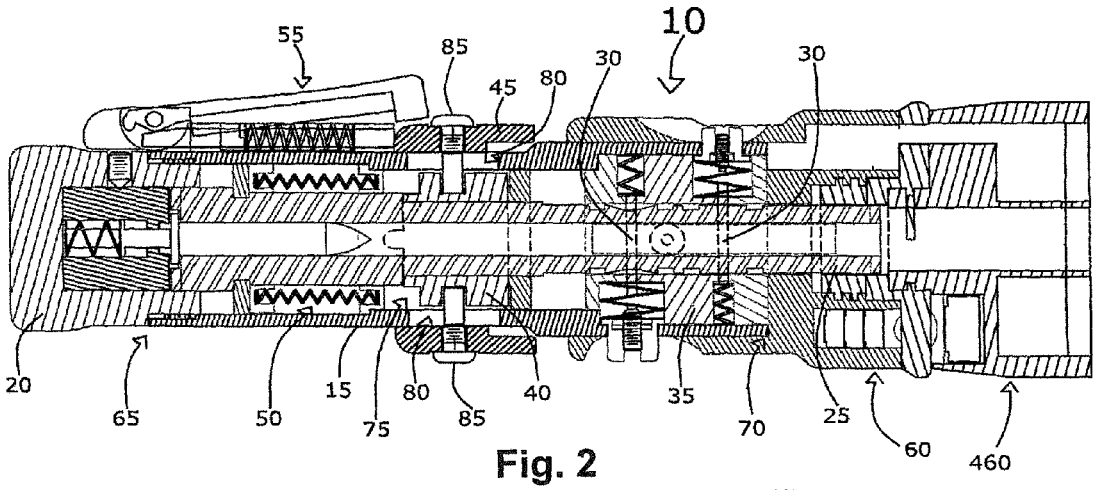
FIG. 2 illustrates a side, cross-section view of a representative embodiment of the firearm.

The described firearm 10 can comprise any suitable component that allows it to discharge a projectile. By way of illustration, FIG. 2 shows some embodiments in which the firearm 10 comprises a main frame 15, an end cap 20, a barrel 25 that is slidably received within the main frame 15, a sear 30, a trigger block 35, a cocking block 40, a cocking ring 45, a proximal biasing mechanism 50, a cocking assist mechanism 55, and a distal end attachment 60. To better describe the firearm, each of the aforementioned components is discussed below in more detail.

With respect to the main frame 15, the main frame can perform any suitable function, including acting as a sleeve that both houses various parts of the firearm 10 and that serves as a handle for holding the firearm. Furthermore, the main frame can have any suitable shape that allows it to function as intended. Indeed, in some non-limiting examples, the outer surface of the main frame is substantially cylindrical (e.g., so as to resemble some conventional flashlights), rectangular, octagonal, hexagonal, polygonal, irregular, etc. By way of illustration, FIG. 2 (and FIG. 1) shows some embodiments in which the outer surface 18 of the main frame 15 is cylindrically shaped.

While the main frame 15 can comprise any suitable component or characteristic that allows it to perform the described functions, FIG. 2 shows an embodiment in which the main frame 15 comprises a proximal end 65, a distal end 70, and an inner cavity 75 that extends between the two ends. Although the inner cavity 75 can perform any suitable function, FIG. 2 shows some embodiments in which it slidably receives the barrel 25, the cocking block 40, and the trigger block 35.

Figure 3A:
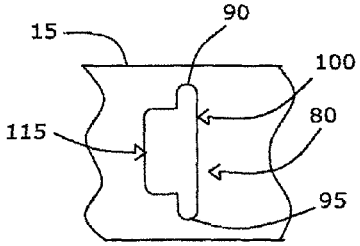
FIGS. 3A-3B each illustrate a top schematic view of a main frame defining an opening.
Figure 3B:
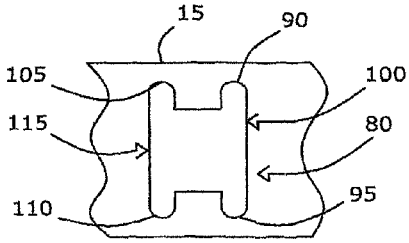

FIG. 2 also shows that, in some embodiments, the main frame 15 also comprises one or more main frame openings 80 that allow the cocking ring 45 to mechanically communicate with the cocking block 35 (e.g., via a pin 85). While the opening can have any suitable shape that allows the cocking ring to be used to move the barrel to a cocked position and/or between a fire and safe alignment (described hereinafter), FIG. 3A shows an embodiment in which the opening 80 optionally comprises a distal safety recess 90 and a distal fire recess 95 that are each disposed at opposite sides of a distal end 100 of the opening 80. As described hereinafter, the distal safety and fire recesses can allow the barrel 25 to rotate between a safe and a fire alignment when the firearm 10 is configured to fire a projectile through a proximal movement of the barrel. In another embodiment shown in FIG. 3B (e.g., an embodiment (not shown) in which the cocking block is configured in an H-shape, as mentioned below), the opening 80 optionally comprises a proximal safety recess 105 and a proximal fire recess 110 that are each disposed at opposite sides of a proximal end 115 of the opening. As described hereinafter, the proximal safety and fire recesses can allow the barrel to rotate between a safe and a fire alignment when the firearm is configured to fire a projectile through a distal movement of the barrel.

Figure 4A:
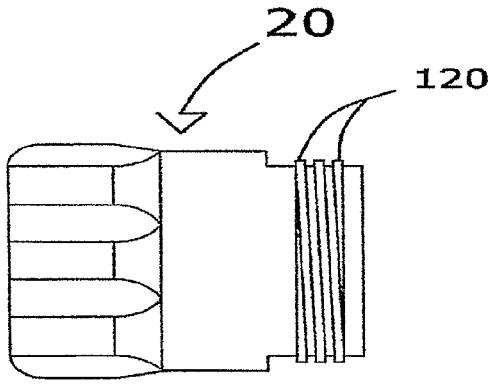
FIG. 4A illustrates a side view of a representative embodiment of an end cap.

Regarding the end cap 20, the end cap can comprise any suitable component or characteristic that allows it to be removed so that a projectile (e.g., a bullet or bullet casing) can be loaded into and/or removed from the firearm 10. In some embodiments, the end cap comprises a connection mechanism that allows it to be selectively attached to and detached from the main frame 15. In this regard, some examples of suitable connection mechanisms include cylindrical threads that correspond to threads on the main frame, a bayonet lock, one or more mechanical fasteners, or any other suitable mechanism. By way of example, FIG. 4A shows an embodiment in which the end cap 20 comprises threads 120 that mate with threads (not shown in FIG. 4A) disposed in the main frame. While the threads 120 can have any suitable characteristic (e.g., lead, pitch, start, etc.) that allows them to be threaded with corresponding threads on the main frame 15, FIG. 4A shows an embodiment in which the threads 120 have a substantially squared profile.

Figure 4B:
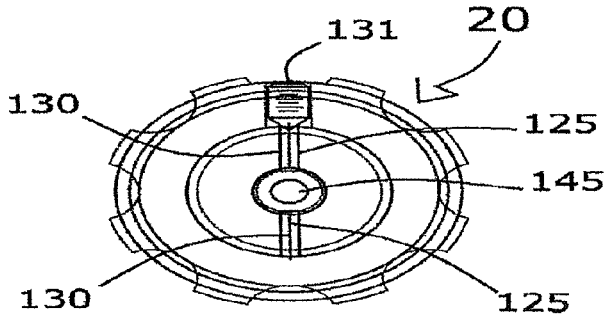
FIG. 4B illustrates a face view of a representative embodiment of an end cap.

In some embodiments, the end cap 20 comprises one or more firing pins. While the end cap can comprise any suitable number of firing pins, including, 1, 2, 3, 4, or more, FIG. 4B shows that, in some embodiments in which the firearm 10 is configured to fire a rim-fire projectile (e.g., a .22 magnum round), the end cap 20 comprises 2 firing pins 125, which can help provide a uniform ignition to the projectile.

The firing pins 125 can have any suitable characteristic that allows firearm 10 to discharge or fire a projectile when the barrel 25 moves proximally to strike a projectile against the firing pins. Indeed, in some embodiments, the firing pins are stationary with respect to the end cap 20 (e.g., via a pin 131, such as an Allen screw, shown in FIG. 4B or in any other suitable manner). In other words, unlike some conventional firing pins that move to strike a projectile primer (e.g., a percussion cap, a rim fire, or a primer cap), some embodiments of the described firearm have a firing pin that remains stationary so as to be struck by a primer that is carried to the stationary firing pin (e.g., via the sliding barrel 25, as discussed below).

Figure 5:
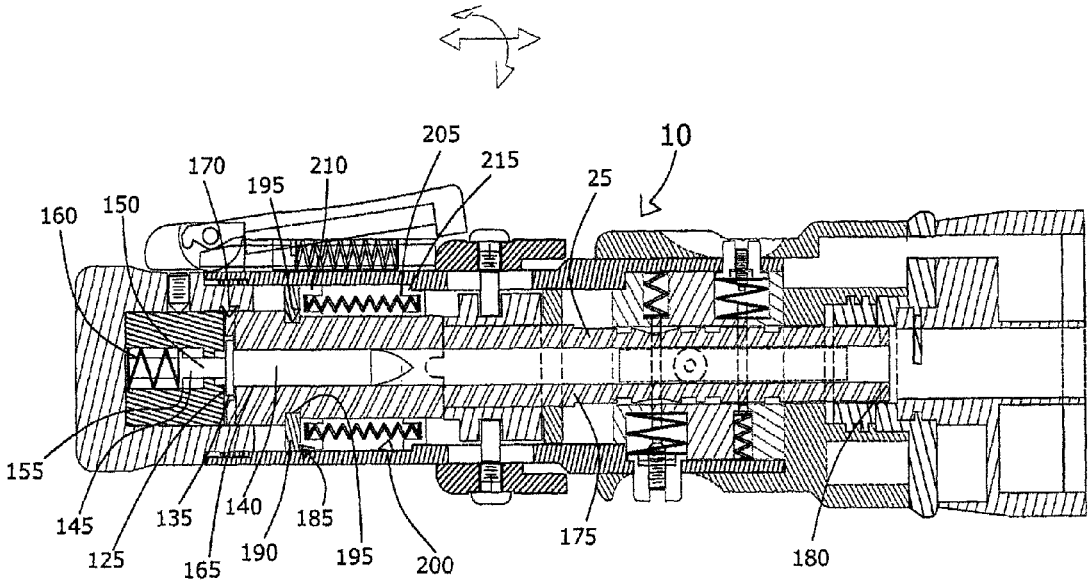
FIG. 5 illustrates a side, cross-sectional view of a representative embodiment of the firearm.

In another example of a suitable characteristic of the firing pins 125, each firing pin can comprise one or more pins, blades, posts, bumps, or other members that allow the pin to function as intended. Indeed, in some embodiments in which the firearm 10 discharges a rim-fire projectile (e.g., a .22 magnum round), FIG. 4B shows the firing pins 125 comprise blades 130 that are sized and shaped to be struck by the rim 135 of a rim-fire bullet 140 (as shown in FIG. 5). In other embodiments in which the firearm fires a center-fire projectile (not shown), the firing pin comprises a pin that is configured to be struck by the projectile's primer.

The firing pin 125 can be disposed in any suitable location that allows it to fire a projectile when the projectile's primer strikes the pin. For instance, FIG. 4B shows an embodiment in which two firing pins 125 are disposed in-line with each other. In another embodiment (not shown), where the firing pin comprises a pin configured to be struck by the primer of a center-fire projectile, the pin is disposed in a position that allows the primer to strike the pin when the barrel moves proximally within the main frame 15.

In some embodiments, the end cap 20 further comprises a biased following pin. In such embodiments, the following pin can perform any suitable function, including acting to hold a projectile (e.g., bullet casing) in the barrel 25 by applying pressure to the proximal end of the projectile and/or acting as a bolt face to retain the projectile (e.g., the projectile's casing) in the barrel when the projectile is fired. Although the following pin can act as a bolt face in any suitable manner, in some embodiments as a projectile is forced proximally against the following pin, the following pin also moves proximally until it bottoms out, or it is otherwise prevented from moving further proximally.

While the following pin can comprise any suitable component that allows it to perform the described functions, FIG. 5 shows an embodiment in which the following pin 145 comprises a shaft 150, a following pin projection 155, and a following pin biasing mechanism 160 (e.g., one or more springs) that contacts the following pin projection to bias the following pin. In another embodiment (not illustrated), the shaft surrounds (or is proximate to) a stationary firing pin. In this embodiment, the firing pin extends distally past the following pin when following pin is forced proximally to its fullest extent. Accordingly, the firing pin and following pin in this embodiment allow the firearm 10 to discharge a center-fire round (e.g., a shotgun shell) through the proximal movement of the barrel 25.

The barrel 25 can comprise any suitable component or characteristic that allows it to slide proximally and/or distally in the main frame 15 in order to discharge or fire a projectile. In one example, FIG. 5 shows that the barrel 25 comprises a projectile chamber 165 at its proximal end 170 and an elongated cylindrical tube 175 that extends to a distal end 180 of the barrel 25. In this manner, the movement of a projectile disposed within the barrel can be tied to the movement of the barrel. In other words, when the barrel moves proximally within the main frame 15, a projectile (e.g., .22 round) disposed in the chamber will move likewise.

In some embodiments, the barrel 25 comprises a retention mechanism that allows the barrel to be biased by a proximal biasing mechanism, or a mechanism that biases the barrel in a proximal direction. In this regard, the retention mechanism can comprise any suitable component that allows the proximal biasing mechanism to bias the barrel. By way of non-limiting example, FIG. 5 shows an embodiment in which the retention mechanism 185 comprises a retainer (e.g., a C-washer) 190 that mates with a retainer groove 195 in the barrel 25.

The proximal biasing mechanism can comprise any component that allows it to bias the barrel 25 proximally in the main frame 15. Indeed, while the proximal biasing mechanism 200 can comprise one or more springs, FIG. 5 shows an embodiment in which the biasing mechanism 200 comprises multiple springs 205 that extend between a proximal spring carrier 210 and a distal spring carrier 215. While the biasing mechanism can comprise any suitable number of springs, including, 1, 2, 3, 4, 5, 6, 7, 8, 9, 10, or more, in some embodiments, the biasing mechanism comprises 10 coiled springs that are equally spaced apart (e.g., each within a corresponding depression of the proximal 210 and distal 215 spring carriers) to allow the proximal biasing mechanism to apply a substantially uniform force around a circumference of the barrel.

While the springs 205 in the proximal biasing mechanism 200 can have any suitable characteristic that allows them to bias the barrel 25 to move towards a discharged position, in some embodiments, the springs are configured to apply little to no tension on the barrel when the barrel is in the discharged position (or a position in which the barrel is moved to its proximal-most position, as shown in FIG. 5). Thus, when the barrel is moved distally toward a distal cocked position (as described below), the proximal biasing mechanism biases the barrel towards the firing pins 125.

Figure 6A:
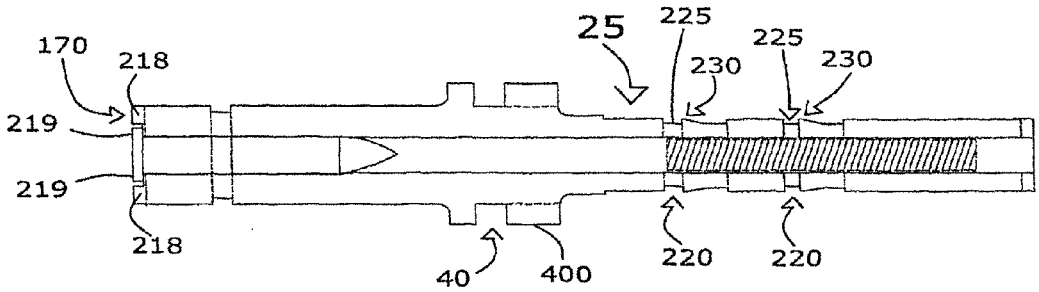
FIG. 6A illustrates a side, cross-sectional view of a representative embodiment of a barrel.
Figure 6B:
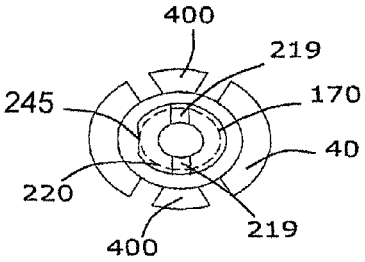
FIG. 6B shows a schematic view of a proximal end of a representative embodiment of the barrel.

Returning to the barrel 25, FIGS. 6A and 6B show that, in some embodiments in which the firearm 10 fires rim-fire projectiles, the proximal end 170 of the barrel comprises a firing pin groove 218 that corresponds to each firing pin 125.

In such embodiments, the firing pins are only able to strike a projectile's primer 219 when the barrel is rotated so that the groove is in alignment with the firing pins. In other words, when the barrel is rotated so that the groove is out of battery with the firing pins, the barrel will strike firing pins and prevent the projectile's primer from striking the firing pins. Accordingly, the firing pin groove can act as safety mechanism to prevent the firearm from being accidentally discharged.

Figure 6C:
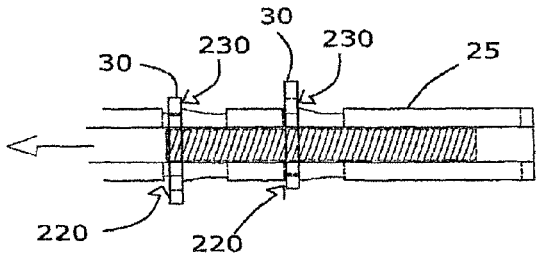
FIG. 6C illustrates a side, cross-sectional view of a portion of representative embodiment in which the barrel is caught by a pair of sears.
Figure 7A:
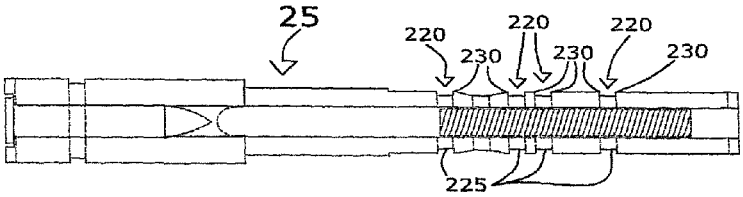
FIG. 7A illustrates a side, cross-sectional view of a representative embodiment of the barrel.
Figure 7C:
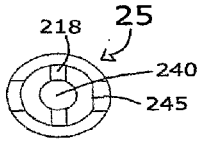
FIGS. 7C-7D each illustrate an end view of the barrel.
Figure 7B:
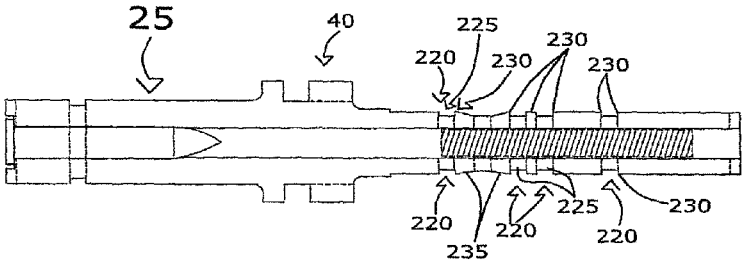
FIG. 7B illustrates a side, cross-sectional view of a representative embodiment of the barrel that includes a representative embodiment of a cocking block.

In some embodiments, the barrel 25 comprises one or more catches on its external surface. In such embodiments, the barrel can comprise 1, 2, 3, 4, or more catches. By way of illustration, FIGS. 6A and 6C show some embodiments in which the barrel 25 comprises 2 catches 220, while FIGS. 7A and 7B show some embodiments in which the barrel 25 comprises 4 catches 220.

Although the catches 220 can serve any suitable function, in some embodiments, one or more catches on the barrel 25 are sized and shaped to be captured by a sear 30 (discussed below) when the barrel is moved to a distal cocked position (shown in FIG. 8A) or a proximal cocked position (shown in FIG. 8B). In this regard, each catch can have any suitable component or characteristic that allows it to perform the described function. For instance, each catch can comprise a groove, a rib, a stop, and/or a protrusion. By way of illustration, FIGS. 7A and 7B show some embodiments in which the catches 220 each comprises a sear groove 225 disposed near a raised surface 230. Additionally, FIGS. 7A and 7B show that the barrel 25 optionally comprises one or more sloped surfaces 235 to help the sear 30 (shown in FIGS. 8A and 8B) engage the catch when the barrel is moved to a cocked position (i.e., a proximal or a distal cocked position).

Figure 7D:
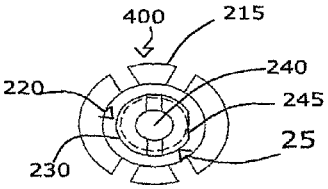

In some embodiments, the barrel 25 is configured to be able to slide past a corresponding sear 30 when the barrel has been rotated about its longitudinal axis 240 to a fire alignment and to be captured by the sear when the barrel is rotated from the fire alignment to a safe alignment. While the barrel can be have any suitable characteristic that allows it to function as described, FIGS. 7C and 7D show an embodiment in which the barrel 25 comprises a flat portion 245 of the raised surface 230 of the catch 220. The manner in which this flat portion functions with the sears is further described below in the discussion regarding the sears 30.

Figure 8A:
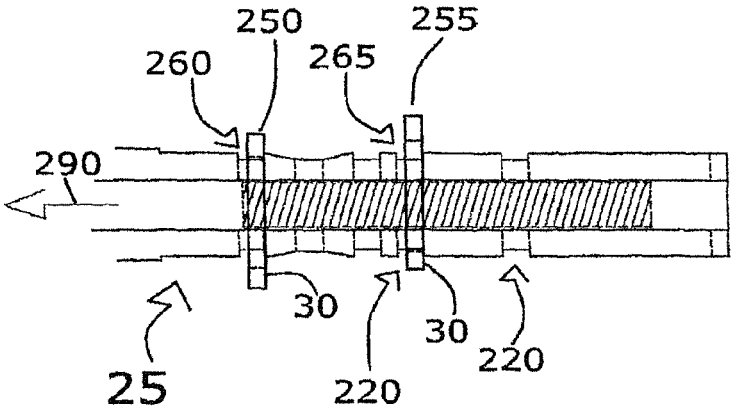
FIG. 8A illustrates a side, cross-sectional view of a representative embodiment of a portion of the barrel captured at a distal cocked position.

As mentioned, some embodiments of the firearm 10 comprise at least one sear 30. Indeed, while the firearm can comprise any suitable number of sears, including 1, 2, 3, 4, or more, FIGS. 8A and 8B show some embodiments in which the firearm comprises 2 sears 30. The sears can each function in any suitable manner that allows them to selectively engage and disengage a corresponding catch 220. By way of illustration, FIG. 8A shows that when the barrel 25 is moved distally to the distal cocked position, a first 250 sear and second sear 255 respectively slip into a first sear groove 260 and a second sear groove 265. FIG. 8B shows that when the barrel 25 is moved proximally to a proximal cocked position (a further discussion of why the barrel can be placed in a proximal cocked position is provided below in a discussion of a launching platform), the first 250 and second 255 sears respectively slide into a third sear groove 270 and a fourth sear groove 275. Thus, when the sears are forced out of the grooves (e.g., by moving the sears in the direction of arrows 280 and 285), the barrel 25 in FIG. 8A is able to move proximally (in the direction of arrow 290) from the distal cocked position towards the firing pins 125, while the barrel 25 in FIG. 8B is able to move distally (in the direction of arrow 290) from the proximal cocked position to strike a projectile primer disposed near a distal end of the main frame (as described below).

Figure 9A:
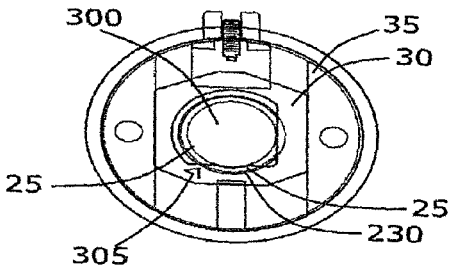
FIG. 9A illustrates a face, schematic view of a representative embodiment of a sear lacking a safety catch, wherein the sear is set in a first layer of a representative embodiment of a trigger block.

The sears 30 can comprise any suitable characteristic or component that allows them to function as described. For instance, FIG. 9A shows an embodiment in which a sear 30 defines a hole 300 that is sized and shaped to allow the barrel 25 to pass therethrough. Additionally, FIG. 9A shows that the sear 30 comprises a catch surface 305. While the catch surface can perform any suitable function, in some instances, when the barrel is moved so that a sear groove 225 aligns with the sear 30, the catch surface slides in a first direction into the groove and contacts the raised surface 230 to prevent the barrel from moving proximally or distally within the main frame 15. In contrast, when the sear is forced in a second direction that is opposite to the first direction, the catch surface is moved out of the groove so that the barrel is able to slide past the sear (e.g., from the cocked position to a discharged position).

Figure 9B:
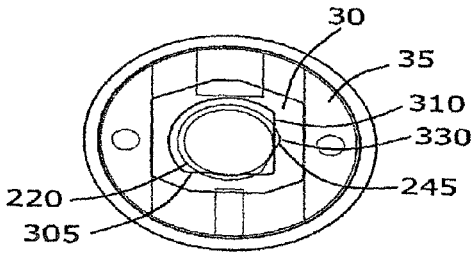
FIG. 9B illustrates a face, schematic view of a representative embodiment of a sear comprising a safety catch, wherein the barrel is not disposed in a fire alignment position, wherein the sear is disposed in a second layer of a representative embodiment of the trigger block.
Figure 9C:
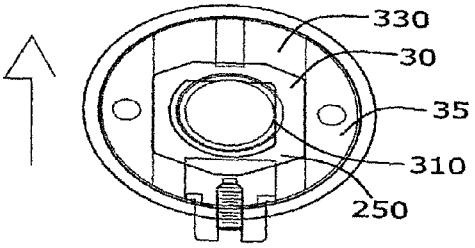
FIGS. 9C-9D each illustrate a face, schematic view of a representative embodiment of a sear.

In some embodiments, one or more sears 30 optionally comprise a safety catch. While the safety catch can perform any suitable function, in some embodiments, the safety catch is sized and shaped so that once the sear is engaged with a corresponding barrel catch 220, the safety catch will only disengage the catch when the barrel is rotated to its fire alignment position. While the safety catch can have any suitable characteristic that allows it to function as intended, in some embodiments, the safety catch corresponds with the flat portion 245 of the barrel 25. Thus, FIG. 9B shows that when a sear 30 is engaged with a barrel catch, and when the barrel 25 is rotated so that its flat portion 245 is not aligned with the safety catch 310, the raised surface 330 is unable to slide past the safety catch, even if the catch surface 305 were disengaged from the raised surface. In contrast, FIG. 9C shows that the sear 30 can be released from the barrel catch when the barrel 25 is rotated (as described below) so that its flat portion 245 aligns with the safety catch 310 (e.g., so that the firing pin groove 218 is aligned with the firing pin 125).

Figure 8B:
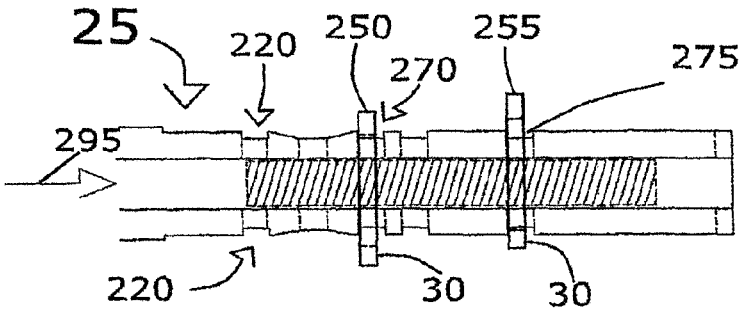
FIG. 8B illustrates a side, cross-sectional view of a representative embodiment of a portion of the barrel captured at a proximal cocked position.
Figure 9D:
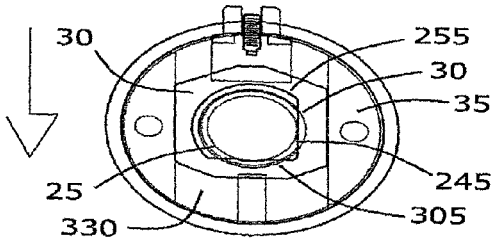
Figure 10:
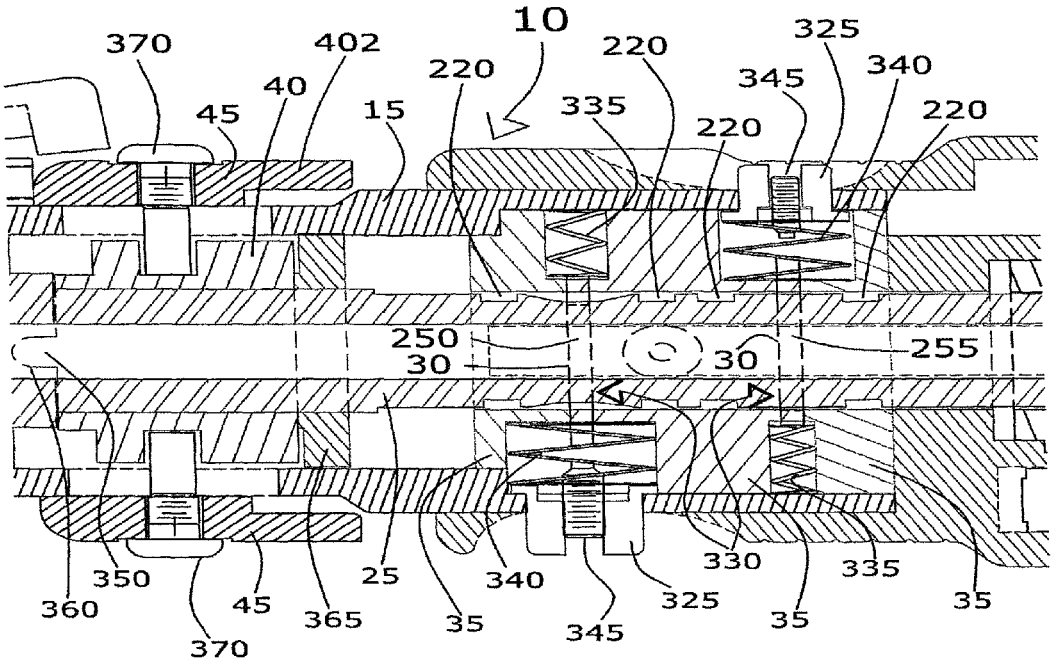
FIG. 10 illustrates a side cutaway view of a portion of a representative embodiment of the firearm.

The sears 30 can be positioned in any suitable place within the firearm 10 that allows them to capture a corresponding barrel catch 220 when the barrel 25 is moved to a proximal cocked position (shown in FIG. 8A) and/or a distal cocked position (shown in FIG. 8B). In one example, FIGS. 9C and 9D show that the sears 30 (e.g., sears 250 and 255) run substantially transverse to the length of the barrel 25. Additionally, while the sears can be disposed in any suitable orientation with respect to each other, FIGS. 9C through 10 show some embodiments in which the first 250 and second 255 sears are disengaged by moving the sears in substantially opposite release directions (as illustrated by arrows 315 and 320, respectively). Accordingly, as shown in FIG. 10, in some embodiments, the sears 250 and 255 are operated by buttons 325 (or triggers) that are disposed on opposite sides of the main frame 15. Thus, where the firearm 10 comprises two sears (e.g., sears 250 and 255), the barrel 25 can be released from its cocked position as both sears and simultaneously disengaged from a corresponding barrel catch 220.

While the sears 30 can be disposed in the firearm 10 in any suitable manner, FIG. 10 (as well as FIGS. 9C and 9D) show some embodiments in which each of the sears 30 is slidably disposed within a slot 330 of the trigger block 35. Additionally, while the sears can be operated in any suitable manner, FIG. 10 shows an embodiment in which each sear 30 has a first sear biasing device (e.g., one or more springs) that biases the corresponding sear towards a corresponding button 325. Additionally, FIG. 10 shows an embodiment in which each sear 30 has a second sear biasing device (e.g., spring) that is weaker than the first sear biasing device 335, and that serves to bias a corresponding button 225 away from the sear 30. Thus, when the firearm is cocked, the barrel 25 is in fire alignment (where applicable), and as a user pushes the button sufficiently hard, the button forces the corresponding sear (e.g., pin 345) to move and to disengage from any barrel catch 220.

In some cases, in order to adjust how far the buttons 325 must be forced before the sears 30 can be disengaged (and the firearm 10 can be discharged), FIG. 10 shows that each button 325 is optionally adjustable. Although the buttons can be adjusted in any suitable manner, FIG. 10 shows some embodiments in which each button 325 comprises an adjustable pin (e.g., an Allen screw or other screw) that can be tightened or loosened in order to adjust the stroke of the button that is needed to disengage the corresponding sear.

With respect to the cocking block 40, the cocking block 40 can be attached to the barrel 25 in any suitable manner. By way of example, the cocking block can be integrally formed with, welded to, attached with mechanical fasteners, or otherwise attached to the barrel in a manner that enslaves the movement of the cocking block to the movement of the barrel. Indeed, FIG. 10 shows an embodiment in which the cocking block 40 includes one or more tabs 350 at its proximal end 355 that mate with corresponding slots 360 in the barrel 25. Additionally, FIG. 10 shows that, in some implementations, a distal fastener (e.g., a threaded washer 365) is used to secure the cocking block 40 to the barrel 25.

Figure 11:
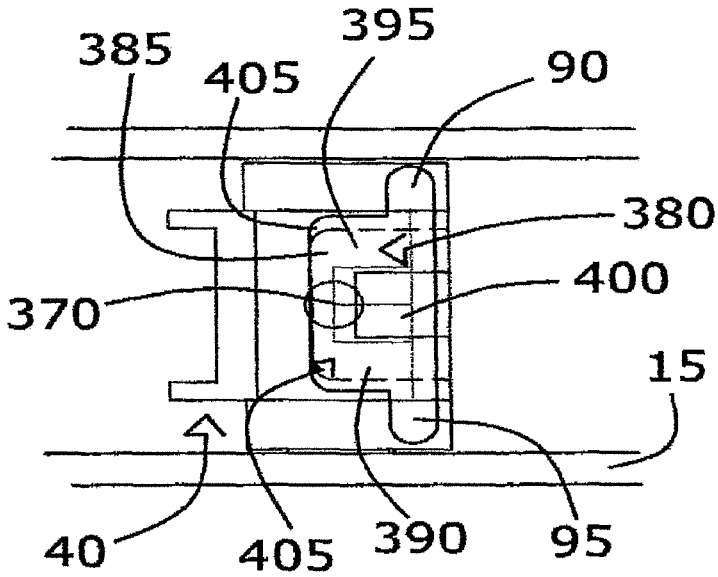
FIG. 11 illustrates a top, schematic view of a representative embodiment of an opening in the main frame and a representative embodiment of a cocking block channel having a portion of a representative cocking ring member disposed therein.

The cocking block 40 can have any suitable characteristic that allows the barrel 25 to be moved proximally and/or distally within the main frame 15 and/or to be rotated between a fire alignment and a safe alignment through distal and/or proximal movement and/or rotation of the cocking ring 45. In this regard, some embodiments of the cocking block include at least one channel that receives a member (e.g., pin 370) extending from the cocking ring. While this channel can have any suitable shape (including a U-shape, an H-shape, a V-shape, etc.), FIG. 11 shows an embodiment in which the channel 375 includes a U-shaped portion 380. More specifically, FIG. 11 shows an embodiment in which the channel 375 comprises a channel that runs transverse to the length of the barrel 25 (the transverse channel 385) and two channels that run with the length of the barrel (the fire channel 390 and the safety channel 395), wherein the two channels are separated by a tang 400.

The cocking ring 45 can comprise any suitable component that allows its distal, proximal, and/or rotational movement about the main frame 15 to cause the barrel 25 to move distally, proximally, and/or to rotate. In some embodiments, however, the cocking ring comprises an element that is movably attached to the firearm (e.g., a ring 402 (see FIG. 10) extending around a circumference of the main frame), wherein the element comprises one or more cocking ring members 370 (e.g., pins, projections, bolts, screws, etc.) that are attached to the member, that extend through the opening 80 in the main frame 15, and that are movably received in the channel 375 of the cocking block 40.

The cocking ring 45 can interact with the cocking block 40 in any suitable manner that allows the cocking ring to move the barrel 25 to a cocked position (e.g., a distal and/or proximal cocked position) and/or between a fire alignment (e.g., an alignment in which the firing pin grooves 218 at the proximal end 170 of the barrel are in battery with the firing pins 125) and a safe alignment (e.g., an alignment in which the grooves at the proximal end of the barrel are not in battery with the firing pins). In one example in which the firearm 10 is cocked by moving the barrel to the distal cocked position (as shown in FIG. 8A), the cocking process involves ensuring that the cocking ring member 370 is disposed within the transverse channel 385 (as shown in FIG. 11). Thus, when the cocking ring member is disposed within the fire channel 390 or the safety channel 395, the cocking ring is moved proximally until the cocking ring member is disposed within the transverse channel.

Figure 12B:
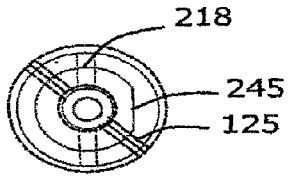
FIGS. 12B, 12D, and 12F each illustrate a view showing the relationship between a firing pin and a firing pin groove for the configurations that are respectively set forth in FIGS. 12A, 12C, and 12E.
Figure 12D:
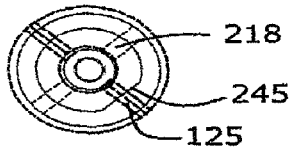
Figure 12A:
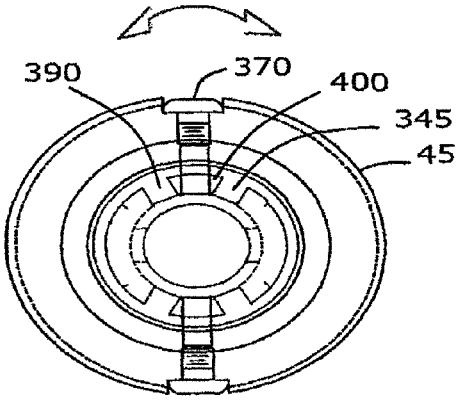
FIGS. 12A, 12C, and 12E each illustrate a cross-sectional schematic view of a representative embodiment of the firearm taken through the cocking block.

Once the in cocking ring member 370 is disposed within the transverse channel 385, the cocking ring 45 can be rotated until the cocking ring member is disposed proximal to the tang 400 (as shown in FIG. 12A). At that point, the ring is pushed distally, so that the cocking ring member pushes the tang (and hence the barrel 25) to move distally until the sears 30 engage corresponding catches 220 (e.g., first groove 260 and second groove 265) and the barrel is locked in the distal cocked position.

Figure 12C:
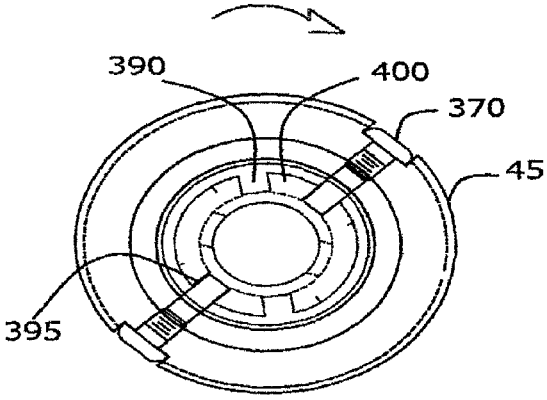

Once the barrel 25 is cocked, the cocking ring 45 can further be rotated so the cocking ring member 370 moves in the transverse channel 385 to the proximal end 405 of either the fire channel 390 or the safe channel 395. When the cocking ring member 370 is disposed at the proximal end of the of the safe channel 395 (as shown in FIG. 12C), FIG. 12D shows that the firing pin grooves 218 and the firing pins 125 are out of battery with each other. Thus, in embodiments in which the sears 30 lack a safety catch 310, when a user disengages all sears, the barrel 25 can slide proximally as the cocking ring member 370 slides through the safe channel. That said, the barrel would protect the projectile's primer from being struck against the firing pins.

Figure 12F:
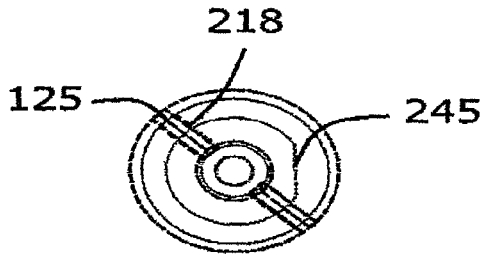
Figure 12E:
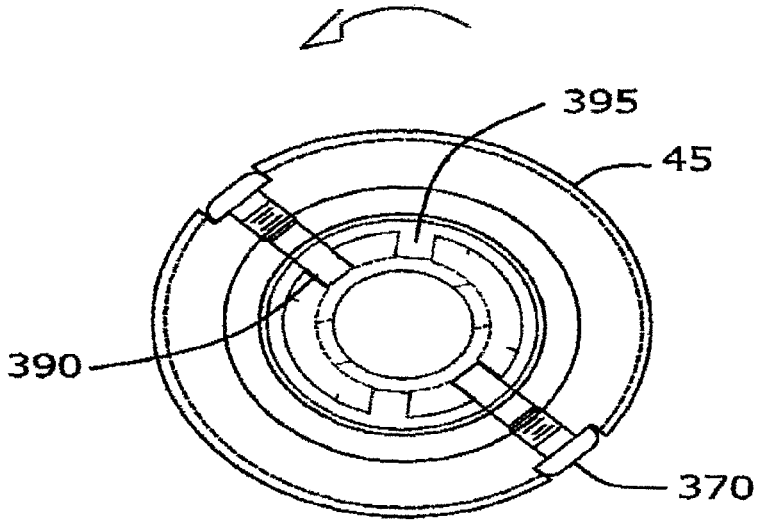

In contrasts, where the cocking ring member 370 is moved to the proximal end of the fire channel 390 (as shown in FIG. 12E) and the cocking ring member 370 is pushed into the distal fire recess 95 (where applicable), FIG. 12F shows that the firing pin grooves 218 and the firing pins 125 are in battery with each other. Thus, if a user were to release the sears 30, the barrel 25 would be able to slide proximally as the fire channel slides past the cocking ring member and a primer of a projectile in the chamber 165 would be discharged as it strikes the firing pins.

In another example in which the firearm 10 is cocked by moving the barrel 25 to the proximal cocked position (as shown in FIG. 8B and as further discussed below), the cocking process involves moving the cocking ring 45 proximally to ensure the cocking ring member 370 is disposed in the transverse channel 385. Once the cocking ring member is in the transverse channel, the cocking ring can be moved proximally, causing the barrel to move proximally, until one or more sears 30 capture corresponding barrel catches 220 (e.g., third groove 270 and fourth groove 275).

Once the barrel 25 is captured in the proximal cocked position, the cocking ring 45 can be rotated to place the cocking ring member 370 at the proximal end of the safe channel 395 or the fire channel 390. When the cocking ring member is disposed at the proximal end of the safe channel and the cocking ring member is rotated into the proximal fire recess 110 (e.g., so that the firing pin grooves 218 and firing pins 125 are aligned), the sears 30 can be released (e.g., by simultaneously pressing buttons 325) so that a distal biasing mechanism (described below) can cause the barrel to slide distally within the firearm 10.

In some embodiments, the firearm 10 optionally comprises a cocking assist mechanism 55. In such embodiments, the cocking assist mechanism can comprise any suitable component or characteristic that allows it help a user move the cocking ring 45 distally on the main frame 15. In one example (not shown), the cocking assist mechanism comprises a lever that is pivotally connected to the main frame so as dispose a cam head near the cocking ring. In this example, when the lever is rotated from its original position, the cam head moves so the cocking ring can be pulled proximally. Then, when the lever is rotated back to its original position, the cam head forces the cocking ring to be moved (and to remain) distally on the main frame.

Figure 13A:
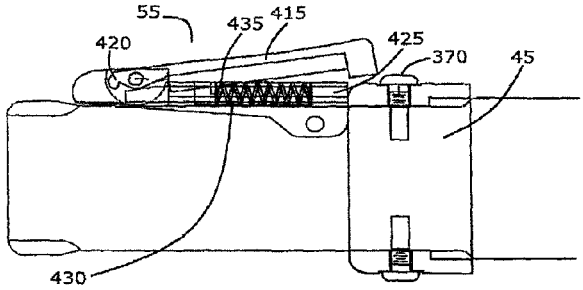
FIGS. 13A-13C each illustrate a side, partial cutaway view of an embodiment of the firearm comprising a representative embodiment of a cocking assist mechanism in a different position.
Figure 13C:
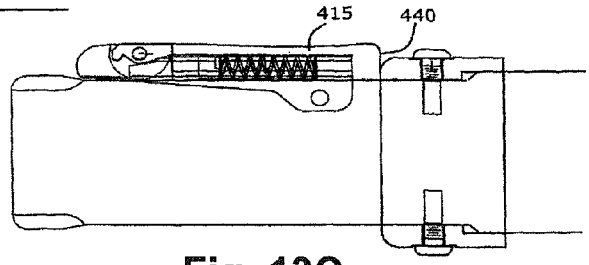
Figure 13B:
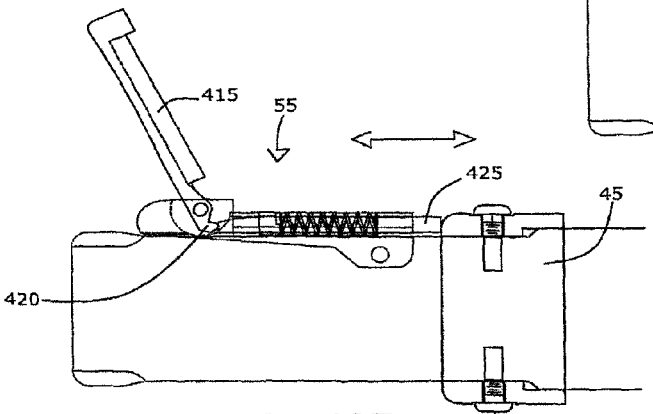

In another example of a suitable cocking assist mechanism 55, FIG. 13A shows an embodiment in which the cocking assist mechanism 55 comprises lever saddle 410, a lever 415 having a cam action pin 420, a slip pin 425, and a cam-pin biasing member 430 (e.g., one or more springs) that applies force to the slip pin (e.g., a pin 435, flange, protrusion, or other connector on the slip pin) to bias the slip pin proximally. In this example, when the lever 415 is lifted (as shown in FIG. 13B), the cam action pin 420 forces the slip pin 425 to move distally. In this manner, the slip pin can force the cocking ring 45 to move distally on the main frame 15 (e.g., to the distal cocked position). Once the cocking ring is moved to a distal position, the lever can be lowered (as shown in FIG. 13C) so that a lever face 440 of the lever 415 prevents the cocking ring from moving proximally until the lever is lifted again.

In some embodiments, the firearm 10 optionally includes a distal end attachment 60 that is disposed at the distal end 70 of the main frame 15. Some examples of suitable distal attachments include a cover, a flashlight, a launching platform, and/or any other suitable component that can be attached (directly or indirectly) to the distal end of the main frame.

Although in some embodiments, the distal attachment 60 is integrally formed with or attached to the main frame 15, in other embodiments, the distal attachment is configured to be selectively coupled to and decoupled from the main frame. In such embodiments, the distal attachment and/or main frame can comprise any suitable attachment mechanism that is capable of attaching a component to the main frame's distal end 70. Some examples of suitable attachment mechanisms include screw threads, a bayonet attachment, an adaptor having threads on one side and a bayonet attachment on the other, one or more mechanical fasteners, clips, the extension of the buttons 325 through holes in the distal attachment, or any other suitable mechanism.

Figure 14:
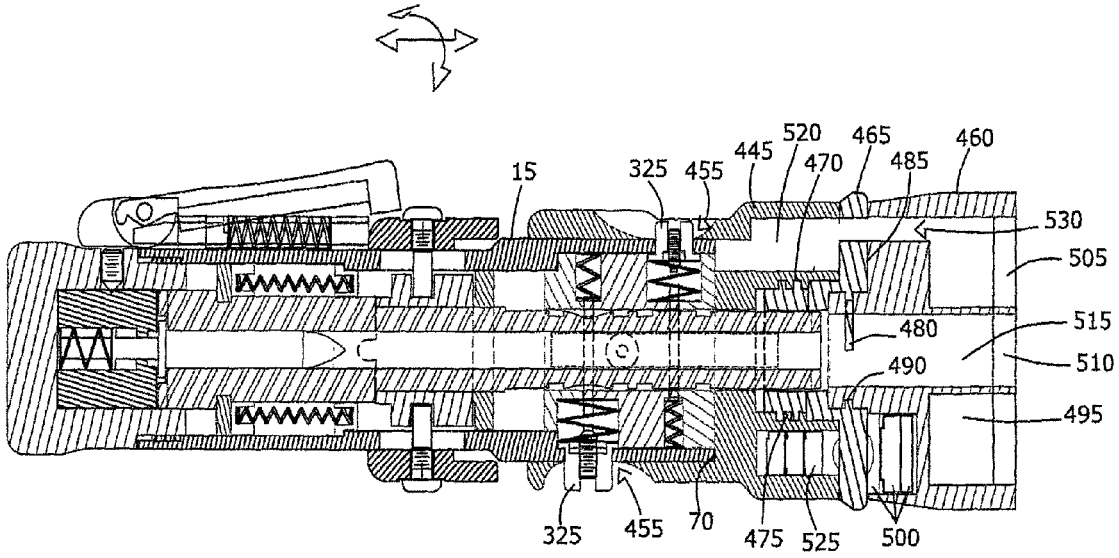
FIG. 14 illustrates a side, cross-sectional view of a representative embodiment of the firearm comprising a representative embodiment of the flashlight.
Figure 15B:
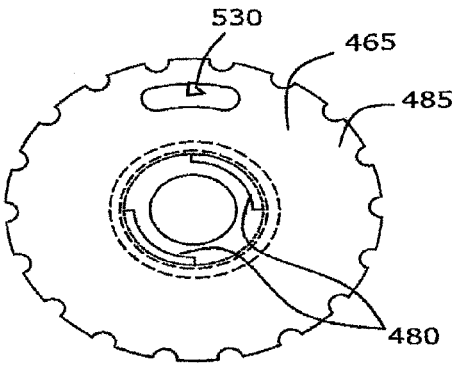
FIGS. 15A-15B illustrate different views of a representative embodiment of an adaptor.
Figure 15D:
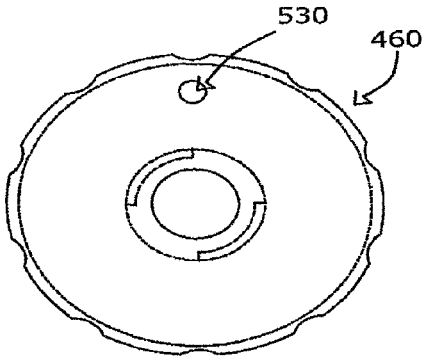
FIGS. 15C-15D illustrate different views of a representative embodiment of the flashlight.
Figure 15A:
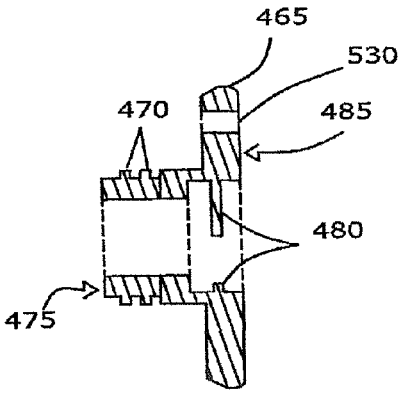
Figure 15C:
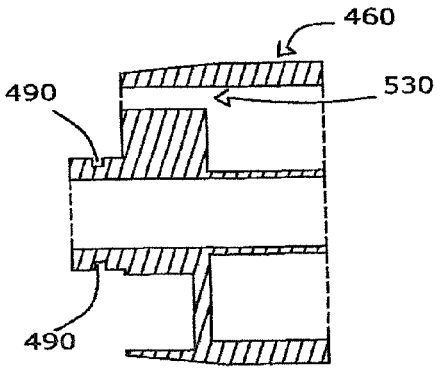

In one example, FIG. 14 shows an embodiment in which a cover 445 is attached to the distal end 70 of the main frame 15 through the use of one or more mechanical fasteners 450 (e.g., screws) and/or the buttons 325 extending through holes 455 holes in the cover. In another example, FIG. 14 (as well as FIGS. 15A through 15D) show some embodiments in which a flashlight 460 attaches to the main frame 15 via an adapter 465 having threads 470 on its proximal side 475 and a bayonet attachment 480 on its distal side 485. In this example, FIG. 14 shows the flashlight 460 comprises a mating bayonet attachment 490 that allows the flashlight to be attached or detached from the adaptor 465 by turning the flashlight a quarter of a turn.

Where a flashlight 460 attaches to the distal end 70 of the firearm 10, the flashlight can have any suitable component or characteristic that allows it to provide light while allowing the firearm to shoot a projectile through the flashlight. Although one or more components (e.g., batteries, switches, wires, electrical connectors, etc.) of the flashlight are disposed in some embodiments of the firearm, in other embodiments, the flashlight is completely self-contained—meaning that the flashlight can provide light without being attached to the firearm. While such a self-contained flashlight can comprise virtually any component that allows it to function as described herein, FIG. 14 (and FIG. 15C) shows an embodiment in which the flashlight 460 comprises one or more light sources 495 (e.g., high-intensity LEDs, incandescent bulbs, etc.), batteries 500, lenses 505 with a hole 510 that allows a projectile to pass therethrough, and holes 515 that pass through the flashlight.

In addition to the described features and components, the firearm 10 can be modified in any suitable manner that allows it to function as described herein. Indeed, in one example, the firearm comprises a laser aiming system. While the laser and its various components can be disposed in any suitable component of the firearm, including the main frame 15 and/or distal attachment 60 (e.g., the flashlight 460), FIG. 14 shows an embodiment in which the laser aimer 520 and its batteries 525 are disposed near the main frame's distal end 70 and in which the flashlight 460 defines an opening 530 that allows the laser beam (not shown) to shine through the flashlight. While the laser aimer can be turned on and off in any suitable manner, in some embodiments, the laser aimer is operated by a switch associated with one or more of the buttons 325 that control the sears 30.

Figure 16:
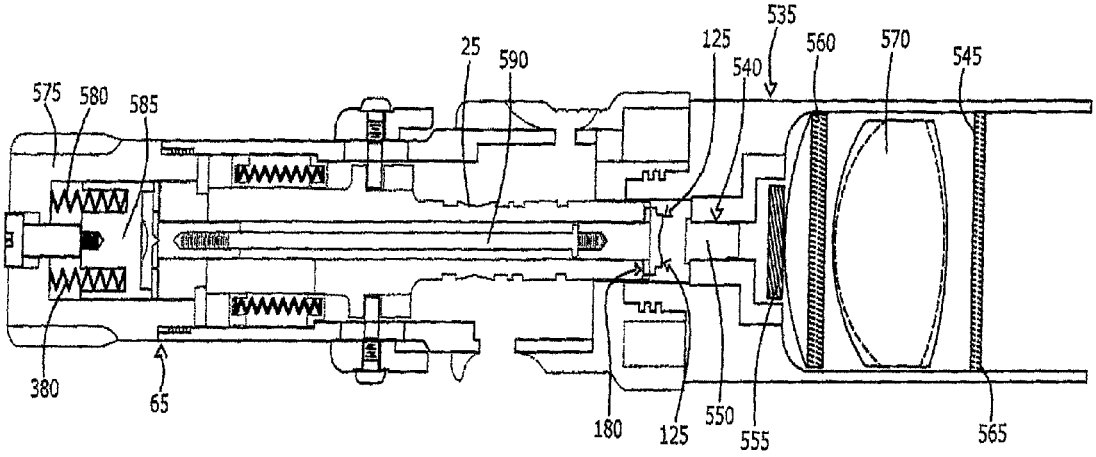
FIG. 16 illustrates a side, cross-sectional view of a representative embodiment of the firearm comprising a representative embodiment of a launching platform.

In another example, the firearm 10 is modified as a launching platform is attached to the distal end 70 of the main frame 15. In this example, the launching platform can comprise any suitable component that allows the firearm to shoot or discharge a projectile that is disposed near the distal end of the main frame (as opposed to firing a projectile that is disposed at a proximal end 170 of the barrel 25). By way of illustration, FIG. 16 shows an embodiment in which the launching platform 535 comprises a chamber 540 and a projectile cavity 545. In this regard, while the chamber can be used to hold any type of projectile (e.g., a lethal round, such as a center-fire round or a rim-fire round), in some embodiments, FIG. 16 shows the chamber 540 holds a blank round 550 to convert the firearm to a less-lethal or a less-than-lethal device that can launch one or more relatively large objects (such as bean bags, canisters, nets, balls, ropes, or other projectile objects).

The platform 535 can have any suitable component or characteristic that allows a projectile to be launched from it. By way of illustration, FIG. 16 shows an embodiment in which the launching platform 535 comprises a wad 555 disposed adjacent to the blank 550 and a seal (e.g., a thick seal 560 and a thin seal 565 on each side of a projectile 570 (e.g., a large bag).

Where the firearm 10 comprises a launching platform 535, the firearm can be configured to discharge a projectile from the platform in any suitable manner that involves releasing the barrel 25 from the proximal cocked position (as described above) and allowing the barrel to slide distally within the main frame 15. In one example, the firearm is modified so it has a distal biasing mechanism that is capable of forcing the barrel distally (or forward) when the barrel is released from the proximal cocked position. For instance, FIG. 16 shows an embodiment in which a modified end cap 575 comprising a distal biasing mechanism 580 (e.g., one or more springs) and a hammer 585 is attached to the proximal end 65 of the main frame 15.

Figure 17:
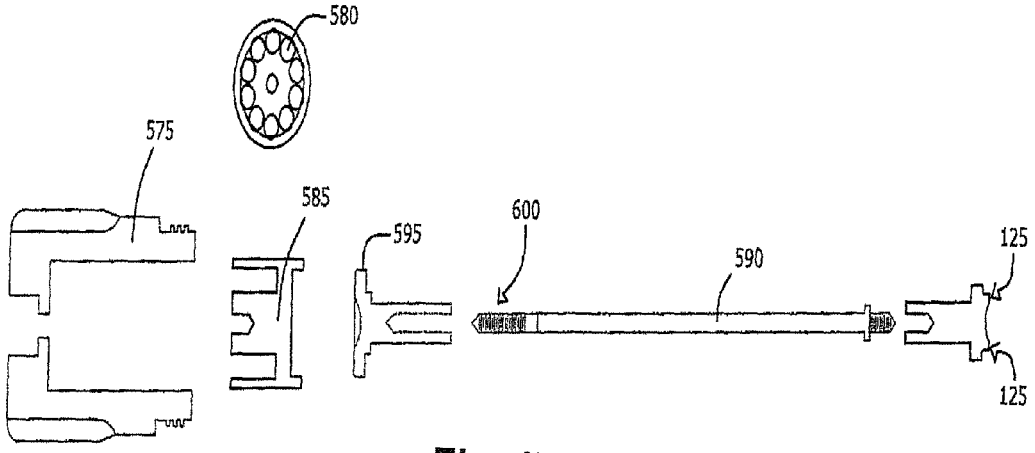
FIG. 17 illustrates a side, exploded view of a representative embodiment of some components that are used to modify the firearm and make it able to shoot projectiles from the launching platform.

In another example of how the firearm 10 can be modified to fire projectiles from the launching platform 535, the barrel 25 is configured to comprise one or more firing pins 125 at its distal end 180. While the firing pins can be disposed at the distal end of the barrel in any suitable manner, FIGS. 16 and 17 show that, in some embodiments, a rod 590 is inserted into the barrel 25, wherein the rod comprises one or more firing pins 125 at its distal end 590. While the rod can be secured in the barrel in any suitable manner, FIGS. 16 and 17 show some embodiments in which a proximal flange 595 is attached (e.g., threaded, frictionally engaged, or otherwise coupled to) to a proximal end 600 of the rod. Thus, when the barrel is released from the proximal cocked position, the firing pins move distally to strike the primer of the projectile 550 disposed in the launching platform and thereby shoot the projectile.

The firearm 10 can be made in any suitable manner that forms the structures described. By way of example, the various components of the firearm can be formed through a process involving molding, extruding, casting, cutting, grinding, stamping, bending, drilling, bonding, welding, mechanically connecting, a layering process, and/or any other suitable process.

As discussed above, the described firearm 10 can have several beneficial characteristics. In one example, the firearm is customizable to fire a variety of different projectiles including lethal projectiles (e.g., a bullet) fired through the proximal movement of the barrel 25 and/or less-lethal or less-than-lethal projectiles (e.g., a net, flare, cord, tranquilizer, ball, bag, etc.) fired through the distal movement of the barrel. Accordingly, the firearm can be used for a variety of different uses, including for self defense, law enforcement, wilderness survival, rescue work, airline security, military, etc.

In another example, in embodiments in which the firearm 10 comprises the flashlight 460, the firearm may not be quickly recognized as such. Accordingly, its user may be able to hold the firearm without the firearm frightening bystanders. Furthermore, in embodiments in which the firearm comprises a flashlight, the user can carry the flashlight and the firearm in the same hand. Thus, the firearm can be readily used when the user is also using the flashlight.

In still another example, because some embodiments of the firearm 10 have a relatively small, cylindrical shape, such embodiments can easily be held and/or concealed. In still another example, some embodiments of the firearm have several safety features. Indeed, because some embodiments of the firearm cannot be fired until the barrel 25 has been cocked (e.g., to the distal or proximal cocked position), the cocking ring 45 has been rotated to a fire position, and both sears 30 are released, the firearm can be operated with relatively little fear of accidental discharge.

Thus, as discussed herein, the embodiments of the present invention embrace firearms. In particular, the present invention relates to systems and methods for making and using a firearm that can be customized to perform one or more functions, such as firing a bullet, firing a less-than-lethal projectile, and/or providing light.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A firearm comprising:

a main frame component having an inner cavity;

a gun barrel that is slidably received within the inner cavity so as to selectively move proximally and distally within the cavity, wherein the barrel comprises a first catch and a second catch on its outer surface; and a first sear that runs transversely with respect to the barrel, wherein the first sear is configured to selectively engage and disengage the first catch to respectively lock the barrel in a proximal cocked position and to disengage the first catch to allow the barrel to move distally to fire the firearm, and wherein the first sear is further configured to selectively engage and disengage the second catch to respectively lock the barrel in a distal cocked position and to release the barrel to allow the barrel to move proximally to fire the firearm.

2. The firearm of claim 1, wherein the first sear is configured to disengage the first catch when a trigger is depressed and translates substantially perpendicularly with respect to a longitudinal axis of the barrel.

3. The firearm of claim 1, wherein an outer surface of the barrel comprises a cocking block having a first channel that runs substantially transverse to a longitudinal axis of the barrel and a second channel that runs substantially along a length of a portion of the barrel;

wherein the firearm further comprises a cocking device comprising a member that extends through the main frame component and that is movably received within the cocking block such that the member is positionable to force the barrel into a cocked position when the member is movably disposed in the first channel and such that the firearm can fire and the barrel can move with respect to the member when the member is in the second channel.

4. The firearm of claim 1, wherein:

the barrel further comprises a third catch, the firearm further comprises a second sear that is configured to translate transversely with respect to the barrel, wherein the second sear is sized and shaped to selectively engage the third catch to lock the barrel in at least one of the proximal cocked position and the distal cocked position, and to disengage the third catch to fire the firearm.

5. The firearm of claim 4, wherein the first sear and the second sear are offset with respect to each other within the firearm so that the first sear and the second sear translate in different directions to release the barrel from the at least one of the proximal cocked position and the distal cocked position.

6. The firearm of claim 1, further comprising a spring-loaded pin disposed near a proximal end of the inner cavity, wherein the pin is attached to the firearm to hold a casing in the barrel and to function as a bolt face when the firearm is discharged from the distal cocked position.

7. The firearm of claim 1, wherein a first side of the first sear is configured to engage the first catch when the barrel is in the proximal cocked position and wherein a second side of the first sear is configured to engage the second catch when the barrel is in the distal cocked position.

8. The firearm of claim 1, further comprising a cocking assist mechanism having a lever that is configured to force the barrel into the distal cocked position.

9. The firearm of claim 1, further comprising a firing pin disposed at a distal end of the barrel, wherein the firing pin is configured to fire the firearm when the barrel is released from the proximal cocked position.

10. The firearm of claim 1, wherein the barrel further comprises a third catch and a fourth catch, wherein the firearm further comprises a second sear, and wherein the second sear is configured to selectively engage and disengage the third catch to respectively lock the barrel in the proximal cocked position and to release the barrel to allow the barrel to move distally to fire the firearm, and wherein the second sear is further configured to selectively engage and disengage the fourth catch to respectively lock the barrel in the distal cocked position and to release the barrel to allow the barrel to move proximally to fire the firearm.

11. The firearm of claim 1, wherein a self-contained flashlight is disposed at a distal end of the firearm, wherein the flashlight comprises a hole that allows a projectile to pass through the barrel and through the hole, and wherein the flashlight is fixed with respect main frame component while the barrel is movable with respect to the flashlight.

12. A firearm comprising:

a main frame component having an inner cavity;

a gun barrel that is slidably received within the inner cavity so as to selectively move proximally and distally within the cavity, wherein the barrel comprises a first catch and a second catch on an outer surface of the barrel, and wherein the barrel is rotatable about its longitudinal axis within the inner cavity so as to rotate between a safe alignment and a fire alignment; and a first sear that is configured to translate transversely with respect to the barrel, wherein the first sear is sized and shaped to selectively engage and disengage the first catch to respectively lock the barrel in a proximal cocked position and to release the barrel to allow the barrel to move distally to fire the firearm, and wherein the first sear is further sized and shaped to selectively engage and disengage the second catch to respectively lock the barrel in a distal cocked position and to release the barrel to allow the barrel to move proximally to fire the firearm.

13. The firearm of claim 12, wherein the first sear is configured to disengage the first catch when a trigger is depressed and translates substantially perpendicularly with respect to a longitudinal axis of the barrel.

14. A firearm comprising:

a gun barrel that is slidably connected to the firearm so as to selectively move proximally and distally within respect to a portion of the firearm, wherein the barrel comprises a first catch and a second catch; and a first sear that runs transversely with respect to the barrel, wherein the first sear is configured to selectively engage and disengage the first catch to respectively lock the barrel in a proximal cocked position and to disengage the first catch to allow the barrel to move distally to fire the firearm, and wherein the first sear is further configured to selectively engage and disengage the second catch to respectively lock the barrel in a distal cocked position and to release the barrel to allow the barrel to move proximally to fire the firearm such that a projectile is fired distally from the firearm.

15. The firearm of claim 14, further comprising a firing pin disposed at a distal end of the barrel, and wherein the firearm further comprises a distal biasing mechanism that is configured to distally bias the barrel from the proximal cocked position towards a discharged position.

16. The firearm of claim 14, wherein the barrel further defines a groove at its proximal end, wherein the groove corresponds to a position of a firing pin disposed near a proximal end of an inner cavity of the firearm that houses the barrel, and wherein the groove only aligns with the firing pin when the barrel is rotated into a fire alignment position.

17. The firearm of claim 14, wherein the barrel comprises a firing pin disposed at its distal end, wherein a projectile launching platform is attached to a distal portion of the firearm, and wherein the projectile launching platform is configured to fire when the barrel moves distally from the proximal cocked position.

18. The firearm of claim 14, wherein the barrel comprises a bullet chamber at a proximal end of the barrel, wherein the firearm further comprises a firing pin disposed at a proximal portion of the firearm, and wherein the firearm further comprises a proximal biasing mechanism to bias the barrel from the distal cocked position, proximally, toward the firing pin, to move the barrel to a discharged position.

19. The firearm of claim 14, wherein an outer surface of the barrel comprises a cocking block having a first channel that runs substantially transverse to a longitudinal axis of the barrel and a second channel that runs substantially along a length of a portion of the barrel; wherein the firearm further comprises a cocking device comprising a member that extends through the main frame component and that is movably received within the cocking block such that the member is positionable to force the barrel into at least one of the proximal and the distal cocked positions when the member is movably disposed in the first channel and such that the firearm can fire and the barrel can move with respect to the member when the member is in the second channel.

20. The firearm of claim 14, wherein the first sear is configured to disengage the first catch when a trigger is depressed and translates substantially perpendicularly with respect to a longitudinal axis of the barrel.

* * * * *